US005611621A

United States Patent [19]

Chien

[11] Patent Number: 5,611,621

[45] Date of Patent: Mar. 18, 1997

[54] SHOE WITH AN EL LIGHT STRIP

[76] Inventor: Tseng-Lu Chien, 8th Fl.-6, No. 9, San Min Rd., Taipei, Taiwan

[21] Appl. No.: 409,925

[22] Filed: Mar. 23, 1995

Related U.S. Application Data

[63] Continuation of Ser. No. 226,330, Apr. 12, 1994, abandoned.

[51] Int. Cl.[6] ..... A43B 23/00

[52] U.S. Cl. ..... 362/84; 362/103; 362/276; 362/802; 36/136; 36/137

[58] Field of Search ..... 362/84, 103, 276, 362/802; 36/136, 137, 45

[56] References Cited

U.S. PATENT DOCUMENTS

| | | | |
|---|---|---|---|
| 3,153,745 | 10/1964 | Gurian et al. | 362/103 |
| 3,946,505 | 3/1976 | Dana | 362/103 |
| 4,158,922 | 6/1979 | Dana | 362/103 |
| 4,748,366 | 5/1988 | Taylor | 36/137 |
| 4,774,434 | 9/1988 | Bennion | 362/103 |
| 4,848,009 | 7/1989 | Rodgers | 362/103 |
| 4,875,144 | 10/1989 | Wainwright | 362/103 |
| 4,949,228 | 8/1990 | Lin et al. | 362/802 |
| 4,999,936 | 3/1991 | Calamia et al. | 36/137 |
| 5,067,063 | 11/1991 | Grahneman et al. | 362/84 |
| 5,149,489 | 9/1992 | Crews | 362/103 |
| 5,152,602 | 10/1992 | Boschetto | 362/802 |
| 5,245,516 | 9/1993 | De Haas et al. | 362/84 |
| 5,317,488 | 5/1994 | Penrod | 362/84 |
| 5,457,900 | 10/1996 | Roy | 36/137 |

FOREIGN PATENT DOCUMENTS

| | | | |
|---|---|---|---|
| 121026 | 10/1984 | European Pat. Off. | 36/137 |
| 2227714 | 11/1974 | France | 36/137 |

*Primary Examiner*—Ira S. Lazarus
*Assistant Examiner*—Sara Sachie Raab
*Attorney, Agent, or Firm*—Bacon & Thomas

[57] ABSTRACT

A lighted shoes having a EL light strip incorporated with D.C. power battery, circuit, function interface, transformer. The EL light strip can put inside of transparent parts of heel or/fix on the shoes surface to get bright light for dark environment application. The flexible strip have transformer to convert the D.C. power into certain specification of A.C. electric pulse to trigger the light strip for illumination.

11 Claims, 4 Drawing Sheets

FIG. 4
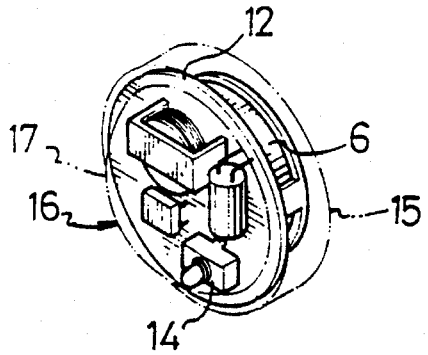
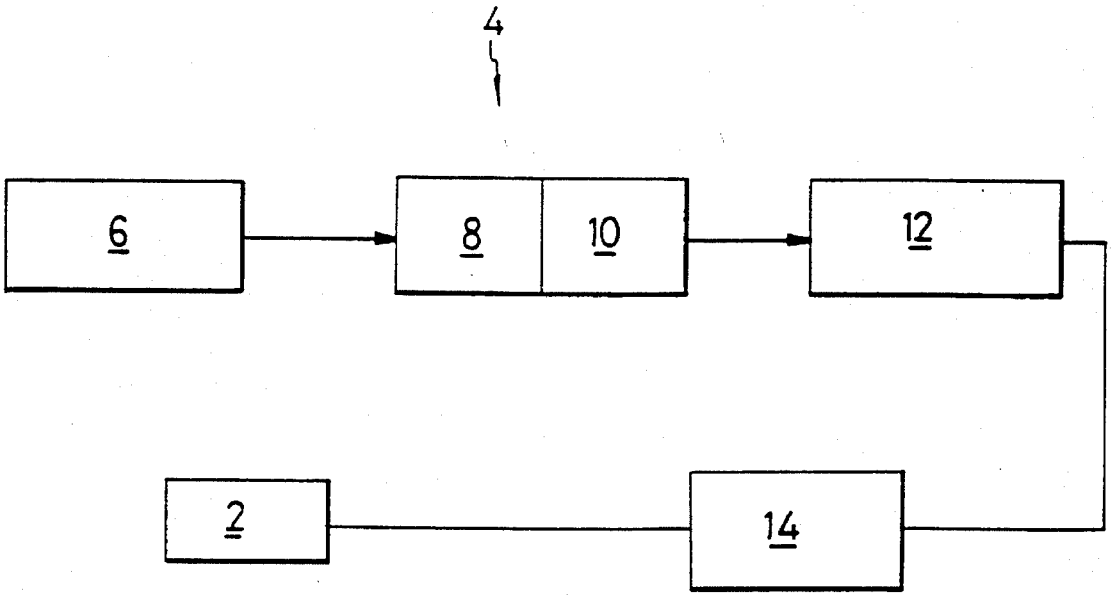
FIG. 2

SHOE WITH AN EL LIGHT STRIP

This application is a continuation of application Ser. No. 08/226,330, filed Apr. 12, 1994, now abandoned.

BACKGROUND OF THE INVENTION

This invention relates to lighted shoes, and in particular to lighted shoes with electro-luminescent (EL) light strips. Lighted shoes, such as shown in U.S. Pat. Nos. 3,893,247 and 3,946,505 have been provided in the past that include a flashing light. When an individual wearing the shoes moves back and forth, as during dancing or even while walking, a circuit provides certain functions such as flashing on and off. Such shoes are very useful and provide enhanced safety for many situations, but the conventional light sources are not as versatile or attractive as EL light strips. However, EL light strips cannot simply be used in the conventional lighted shoes because of different electrical requirements. The conventional power supplies, such as shown in U.S. Pat. No. 4,158,922, which discloses a three position switch with different functions for triggering a light by D.C. power, lack components such as a transformer to convert D.C. power to A.C. power suitable for use in EL applications, and thus the previous arrangements cannot easily be adapted for use with EL strips.

SUMMARY OF THE INVENTION

The present invention uses an EL strip triggered by electric pulses supplied by a D.C. power source and D.C. to A.C. inverter circuit at a certain frequency in place of the conventional D.C. powered flashing light. Rather than being limited to a point sources, large areas of the shoe can be illuminated with different designs while still providing space to hide parts such as a transformer and function interface. Furthermore, the improved lighting effects can be achieved using relatively simple assembly techniques such as stitching or glue, or other similar assembly methods.

The invention thus provides an easier way-to illuminate shoes by using a flexible paper-thin EL strip. It can be put inside of a transparent heel or on the side of the shoe's surface. The light strip is connected to a circuit which includes components for inverting D.C. battery power into A.C. pulses at a certain frequency (Hz). The circuit components include transistors, resistors, capacitors, transformers, and so forth which trigger the light strip. The light can be turned on and off by a vibration, tilt, pressure, or photosensitive switch and an optional timer delay/capacitor can be included to extend the on time for a certain time period, and other components for providing-a variety of lighting effects for different applications. Extra brightness can be obtained by using a capacitor to store power for use when the switch is on, or the switch can have a variable time delay for flashing effects such as flashes steady-on, random flashing, fade in-out, sequential flashes, and mixed effects for multiple lights.

There are two principal ways to assemble the preferred light strip or strips to a shoe. One is for the heel and the other is for the side-surface of the shoe. The heel type requires that some kind of transparent heel material is installed and that the light strip follow the heel's curve. The light strip cannot be put too far away from the outside edge of the heel to prevent the illumination from becoming too weak, This linear light strip can permit the entire contour to be lighted to improve the "narrow viewing angle" of any other light source. Also, the EL light strip or strips are unbreakable and fully waterproof, providing further advantages over conventional lights. Not only are such strips durable, but they also have low power consumption comparable to that of an LED, and more color choices than any other light source, including green, blue, pink, purple, yellow, red, and turquoise. Hence, the appearance of the inventive strip is much more attractive than that of other light sources. Also, different colors can be put together for a rainbow effect. This avoids the limitation of LEDs to a red color, which should be reserved for police use. In the case of an illuminated heel design, all components are not only stored inside of the heel, but also positioned behind the light strip to prevent the electrical components from blocking the light.

In the case of a surface application, the light strip or strips may be put into a transparent soft/stitchable material for surface mounting. The light strip can be silk-screen printed with transparent or non-transparent ink to obtain a much more attractive appearance for daytime or nighttime cosmetic purposes, and can be easily assembled to the shoe by Velcro™, double-sided tape, stitching, glue, or other conventional attachment means. This allows all outside surfaces of the shoes to be lighted for better safety.

It is therefore the primary objective of the present invention to provide useful illuminated shoes that utilize lights having superior flexibility and durability, lower power consumption, are easily manufactured, and provide increased color choice. This and other objects of the invention will become clear from an inspection of the detailed description of the invention and from the appended claims:

BRIEF DESCRIPTION OF THE DRAWINGS

FIG. 2 is a block diagram of a circuit for powering the EL light strips shown in FIG. 1;

FIG. 4 is a perspective view of a first embodiment of the circuit shown in FIG. 3;

DETAILED DESCRIPTION OF THE PREFERRED EMBODIMENTS

Figure 1:
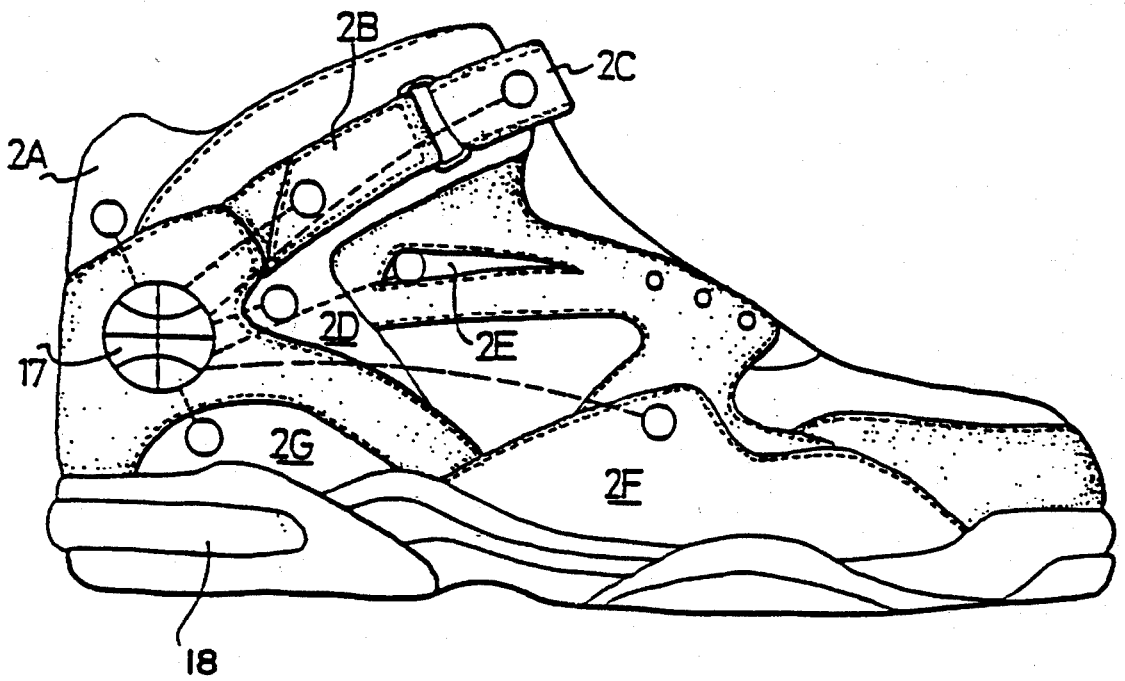
FIG. 1 is a side view of a shoe which uses a plurality of EL light strips in accordance with the present invention.

Referring to FIG. 1, a sports shoe uses a plurality of EL light strips which may be of the type described in the applicant's co-pending U.S. patent application No. 08/156,004. The EL light strips such as 2A, 2B, 2C, 2D, 2E, 2F, and 2G are attached to the sports shoe by means of sewing, gluing, etc., and the electrical circuitry for the EL light strips are located either in a portion of the bottom of the shoe indicated by part or wall 18 or in a housing 16 on the side of the shoe as described in more detail below.

Figure 5:
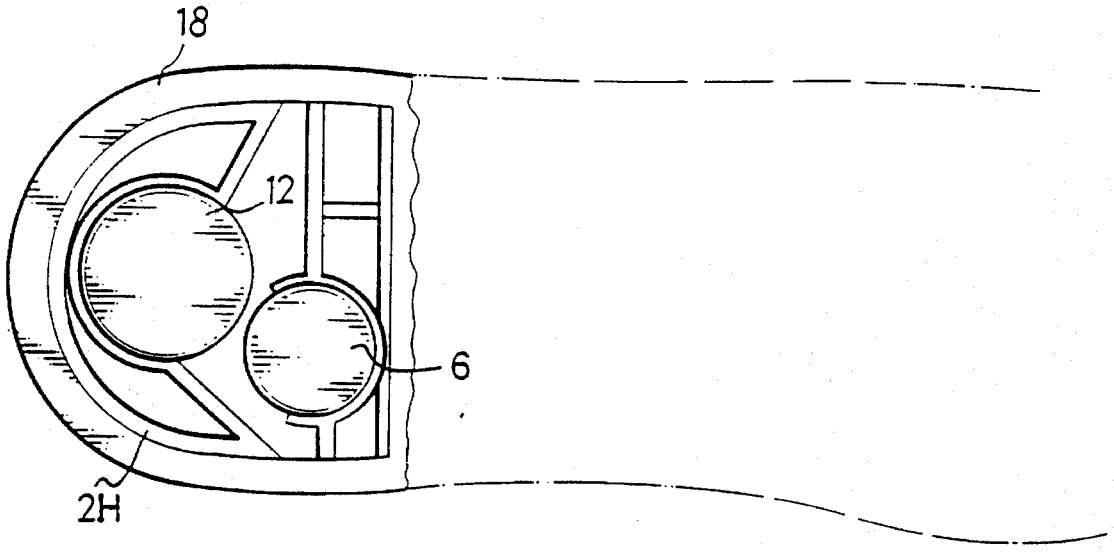
FIG. 5 is a bottom view of a shoe which uses a second embodiment of the circuit shown in FIG. 3.
Figure 3:
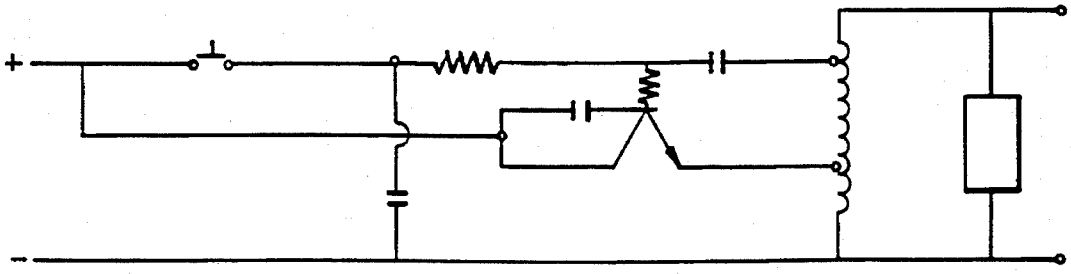
FIG. 3 shows the circuit for powering the EL light strips shown in FIG. 1.

Referring to FIGS. 2, 3 and 4, the EL light strips of the embodiments of FIGS. 1 and 5 (the latter being described below) are powered by means of a circuit 4 which may be placed in the bottom of the shoe or alternatively in a housing on the side of the shoe. The circuit 4 includes a direct current (D.C.) power supply 6 which is connected to an direct-current-to-alternating-current inverter 8. The DC/AC inverter 8 may include a transformer 10 connected to a function interface 12 and a switch 14 connected to the EL light strips.

The DC power supply is used to provide electricity for the EL light strips. For convenience, the DC power supply 6 is preferably a dry battery so that it is easily attached to the sports shoe.

A direct current is sent from the DC power supply 6 to the DC/AC inverter 8 where it is converted into an alternating current. The DC/AC inverter 8 can be selected in order to provide a desired frequency of the alternating current, by means including a transformer 10. The voltage of the AC is increased by means of the transformer 10 and supplied to the function interface 12. The function interface 12 provides a plurality of options which include "regular short interval flashing", "permanent 'ON'", "regular short interval flashing interspersed with regular 'OFF' periods", "irregular interval flashing", and "phased-in and phased-out flashing" so as to provide various ways in which the EL light strips flash. The function interface 12 can be included in or combined with an integrated circuit or other conventional inverter circuitry.

The EL light strips can be turned on and off by means of the switch 14. The switch 14 is a push-button switch as shown in FIG. 4. However, the switch 14 can also include or consist of a vibration-sensing switch, a photosensitive switch, a tilt-sensing switch and/or a pressure-sensing switch.

As shown in FIG. 4, the dry battery 6, the DC/AC inverter 8, the transformer 10, the function interface 12 and the switch 14 may be contained in a housing 16 which consists of a hollow base 15 and an elastic semi-spherical cover 17. Thus, a user can easily press the elastic semi-spherical cover 17 in order to press the switch 14. In this arrangement, which may be used with the embodiments or FIGS. 1 or 6, a pattern may be formed or printed on the external surface of the elastic semi-spherical cover 17 so that the elastic semi-spherical cover 17 looks like a ball.

Figure 6:
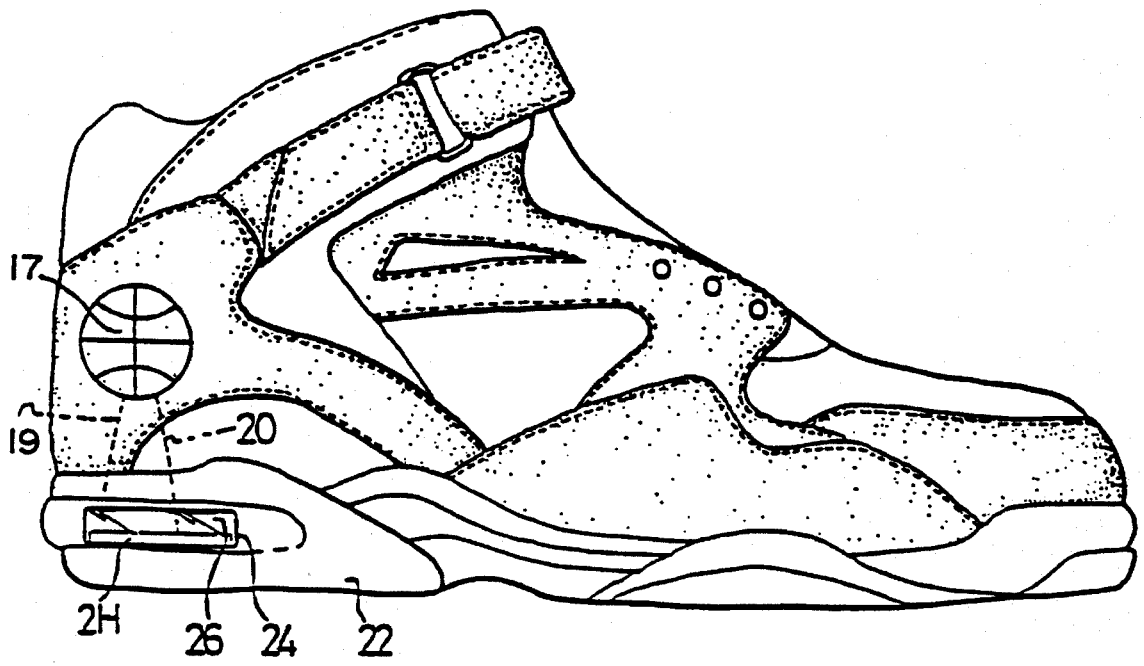
FIG. 6 is a side view of a shoe which uses the second embodiment of the circuit shown in FIG. 3.

Alternatively, the power source and circuit components may be placed in the bottom of the shoe. In the embodiment of FIGS. 5 and 6, the function interface 12 is connected to the switch 14 by means of wires 19. The switch 14 is connected to an EL light strip 2H by means of wires 20. The dry battery 6 and all other circuitry including the function interface 12, the switch 14, and the EL light strip 2H are mounted in the bottom of a sports shoe by defining a power pack 24 in one side of hollow sports shoe heel 22 and covering the power pack with the EL strip 2H. Thus, light which is emitted by the EL light strip 2H is visible through transparent part or wall 18 from the exterior of the sports shoe heel 22. On the other hand, if the power source and circuit components are situated in the bottom of the shoe but the EL strips are on the upper surface of the shoe, then part or wall 18 does not need to be transparent.

What is claimed is:

1. In a shoe, comprising:

a shoe bottom;

an soft upper shoe surface connected to the shoe bottom;

a lighting arrangement; and a DC power supply;

the improvement comprising:

an EL strip;

means including a DC-AC converter connected to the DC power supply for converting direct current supplied by the DC power supply into an alternating current having a frequency capable of activating the EL strip;

a function interface connected between the DC-AC converter and the EL strip;

a switch for controllably disconnecting the EL strip from the power supply;

means for enclosing the DC power supply, the DC-AC converter, the function interface, and the switch within the shoe bottom; and means for attaching the EL strip to the soft upper surface of the shoe.

2. A shoe as claimed in claim 2, wherein the EL strip is enclosed in a soft transparent sleeve.

3. A shoe as claimed in claim 2, wherein the transparent sleeve has transparent ink screen-printed thereon.

4. A shoe as claimed in claim 2, wherein the transparent sleeve has non-transparent ink screen-printed thereon.

5. A shoe as claimed in claim 1, further comprising a plurality of additional EL strips of different colon.

6. A shoe as claimed in claim 1, wherein the switch is a mechanical switch.

7. A shoe as claimed in claim 1, wherein the switch is an electrical switch.

8. A shoe as claimed in claim 1, further comprising means including a transformer for converting the DC power to a signal having a predetermined voltage.

9. A shoe as claimed in claim 1, wherein the function interface includes means for providing pulse signals to the EL strip in order to provide special effects selected from the group consisting of random flashing, and study state, chasing, sequential and fade in-out effects.

10. A shoe as claimed in claim 1, wherein the EL strip attaching means comprises double-sided tape.

11. A shoe as claimed in claim 1, further comprising an outside housing connected to the upper shoe surface for receiving at least one of the DC power supply, the circuit, the function interface, and the switch.

* * * * *